US011440070B1

(12) United States Patent
Bergeson

(10) Patent No.: US 11,440,070 B1
(45) Date of Patent: Sep. 13, 2022

(54) ADJUSTABLE ANGLE STOP FOR BENDING CONDUIT

(71) Applicant: Joel R. Bergeson, West Fargo, ND (US)

(72) Inventor: Joel R. Bergeson, West Fargo, ND (US)

( * ) Notice: Subject to any disclaimer, the term of this patent is extended or adjusted under 35 U.S.C. 154(b) by 0 days.

(21) Appl. No.: 17/196,417

(22) Filed: Mar. 9, 2021

(51) Int. Cl.
*B21D 7/14* (2006.01)

(52) U.S. Cl.
CPC ..... *B21D 7/14* (2013.01)

(58) Field of Classification Search
CPC . B21D 7/02; B21D 7/024; B21D 7/08; B21D 7/085; B21D 7/14; B21D 7/16; B23Q 16/001
See application file for complete search history.

(56) References Cited

U.S. PATENT DOCUMENTS

| | | | | |
|---|---|---|---|---|
| 2,820,504 | A | 1/1958 | Henderson | |
| 3,462,985 | A | 8/1969 | Troyanski | |
| 4,052,881 | A * | 10/1977 | Mount | B21D 7/063 72/31.1 |
| 4,537,052 | A | 8/1985 | Adleman | |
| 6,422,054 | B1 * | 7/2002 | White | B21D 7/02 72/458 |
| 6,820,457 | B2 | 11/2004 | Luebke | |
| 6,834,527 | B2 | 12/2004 | Hopwood | |
| 7,328,601 | B1 * | 2/2008 | King | B21D 7/063 72/369 |
| 7,886,565 | B2 * | 2/2011 | Hainzinger | G01B 3/02 72/149 |
| 8,375,764 | B2 | 2/2013 | Huang | |
| 9,937,617 | B2 * | 4/2018 | Martin | B25H 7/005 72/459 |
| 10,478,882 | B1 * | 11/2019 | Perez | B21D 7/06 72/459 |
| 10,569,320 | B2 | 2/2020 | Nobles | |
| 2004/0182129 | A1 * | 9/2004 | Hopwood | B21D 7/063 72/459 |
| 2015/0033813 | A1 * | 2/2015 | Leclerc | B21D 7/063 72/37 |
| 2017/0274437 | A1 * | 9/2017 | Klinger | B21D 7/02 72/459 |
| 2020/0222963 | A1 | 7/2020 | Barton | |
| 2020/0282505 | A1 | 9/2020 | Benton | |
| 2021/0031254 | A1 * | 2/2021 | Pearson | B21D 7/063 72/459 |

* cited by examiner

*Primary Examiner* — Debra M Sullivan
*Assistant Examiner* — Matthew Stephens
(74) *Attorney, Agent, or Firm* — Neustel Law Offices

(57) ABSTRACT

An adjustable angle stop for bending conduit. The adjustable angle stop generally includes an elongated body comprising a first end and a second end and a stop element at the first end, and an inner surface on the elongated body adapted to engage a conduit. The elongated body may also include a plurality of indexing elements usable to position the angle stop on the conduit, the indexing elements indicating a bend angle. One or more magnets can removably attach the elongated body to the conduit, wherein the adjustable angle stop will contact a part of a bending tool indicative of a predetermined bend angle when the bend angle is reached.

20 Claims, 6 Drawing Sheets

ADJUSTABLE ANGLE STOP FOR BENDING CONDUIT

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to an adjustable angle stop for bending conduit that is usable for making repeatable, accurate angle bends in conduit.

Related Art

Any discussion of the related art throughout the specification should in no way be considered as an admission that such related art is widely known or forms part of common general knowledge in the field.

Markings and physical devices have been available for some time for use with conduit/tubing benders. However, often markings on conduit benders are difficult to see, especially when a user must bend conduit in less-than-ideal conditions, such as when the bender is used with larger diameter conduit that is most easily bent with the conduit braced by the floor. In addition, some physical devices and mechanisms for bending conduit at a particular angle are incorporated in or attached to the bender itself, which makes them less desirable for those who prefer to continue using their existing benders and tools.

SUMMARY

An example embodiment is directed to an adjustable angle stop for bending conduit. The adjustable angle stop for bending conduit includes an elongated body comprising a first end and a second end and a stop element at the first end, and an inner surface on the elongated body adapted to engage a conduit. The stop element may comprise two tabs that extend outwardly from the elongated body, or it may simply be an extended portion of the elongated body of any shape or size. The elongated body may also include a magnet mounted on the elongated body such that the magnet can removably attach the elongated body to the conduit such that the conduit contacts the inner surface, wherein the elongated body is attachable to the conduit in a first position and a second position.

The elongated body may further include at least one indexing element near the second end, the at least one indexing element usable to place an indicator on the conduit at a predetermined distance from the first end when the elongated body is attached to the conduit in the first position, wherein the indicator is usable when attaching the elongated body to the conduit in the second position by indicating the second position. The stop element is adapted to contact a part of a bending tool when the elongated body is in the second position, such that the conduit can be bent at a predetermined angle that is indicated by the at least one indexing element when the stop element is contacted by the bending tool.

In some example embodiments, the inner surface of the elongated body comprises a partial cylindrical surface, and of course other shapes are possible. Further, the elongated body may have a plurality of magnets, which may have top surfaces that are substantially continuous with the inner surface of the elongated body, although they may also differ, such as if the inner surface is formed as a V-block, and the magnets have partial cylindrical surfaces to better engage and hold the metallic conduit.

In some example embodiments of the adjustable angle stop, the at least one indexing element may comprise a plurality of indexing elements. Further, the indexing elements can comprise numbers (and also guide lines) that represent angles at which the conduit can be bent when one of the plurality of indexing elements is used to place the indicator on the conduit.

The elongated body may comprise a wedge shape at the first end, such that the elongated body is narrower at the first end than it is at the second end. Accordingly, the wedge shape creates an angle with the part of the bending tool that is different from an angle between the part of the bending tool and a longitudinal axis of the elongated body.

The adjustable angle stop may be used by attaching the elongated body to the conduit in the first position and placing an indicator, such as a mark, scratch, etc., on the conduit adjacent to the indexing element. The method may further include attaching the elongated body to the conduit in the second position, as indicated by alignment of the first end with the indicator or mark, and then bending the conduit with the bending tool until a part of the bending tool contacts the stop element. In this manner, the conduit can be bent to a predetermined angle corresponding to the indexing element used to place the indicator or mark on the conduit.

In further use of the device, the first position comprises a position of the elongated body in which the first end is aligned with an end of the conduit, wherein the end of the conduit is bent to the predetermined angle. Alternatively, the first position may comprise a position in which the first end is aligned with a separate mark on the conduit, wherein the conduit is bent to the predetermined angle at a location spaced apart from an end of the conduit. When the adjustable angle stop includes a plurality of indexing elements comprising numbers that represent angles at which the conduit can be bent when one of the plurality of indexing elements is used to place the indicator on the conduit, a user may select the indexing element corresponding to a desired bend angle and place a mark or indicator on the conduit adjacent to that indexing element. As noted above, the indexing elements will generally be in the form of a number and line indicative of an angle, so that, for example, a mark next to element with number "45" will result in a 45° bend in the conduit.

Example embodiments of the adjustable angle stop may incorporate any or all of the foregoing features, and methods for using the device as described herein, in any form or combination of features. For example, an angle stop may comprise an elongated body comprising a first end and a second end and two stop tabs at the first end, wherein the elongated body comprises a wedge shape at the first end, such that the elongated body is narrower at the first end than it is at the second end, an inner surface on the elongated body adapted to engage a conduit, wherein the inner surface comprises a partial cylindrical surface, and a plurality of magnets mounted on the elongated body such that the plurality of magnets can removably attach the elongated body to the conduit such that the conduit contacts the inner surface, wherein the elongated body is attachable to the conduit in a first position and a second position and wherein each magnet of the plurality of magnets comprises a top surface that is substantially continuous with the inner surface. The angle stop may also include a plurality of indexing elements near the second end, and any one of the plurality of indexing elements may be usable to place an indicator on the conduit at a predetermined distance from the first end when the elongated body is attached to the conduit in the first position. As with other embodiments, the indicator or mark on the conduit is usable when attaching the elongated body to the conduit in the second position by indicating the second position so that the adjustable angle stop can be removably attached to the conduit in the correct location and orientation. The two stop tabs are adapted to contact a part of a bending tool when the elongated body is in the second position, such that the conduit can be bent at a predetermined angle that is indicated by the at least one indexing element when the two stop tabs are contacted by the bending tool.

There has thus been outlined, rather broadly, some of the embodiments of the adjustable angle stop in order that the detailed description thereof may be better understood, and in order that the present contribution to the art may be better appreciated. There are additional embodiments of the adjustable angle stop for bending conduit that will be described hereinafter and that will form the subject matter of the claims appended hereto. In this respect, before explaining at least one embodiment of the adjustable angle stop in detail, it is to be understood that the adjustable angle stop is not limited in its application to the details of construction or to the arrangements of the components set forth in the following description or illustrated in the drawings. The adjustable angle stop for bending conduit is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
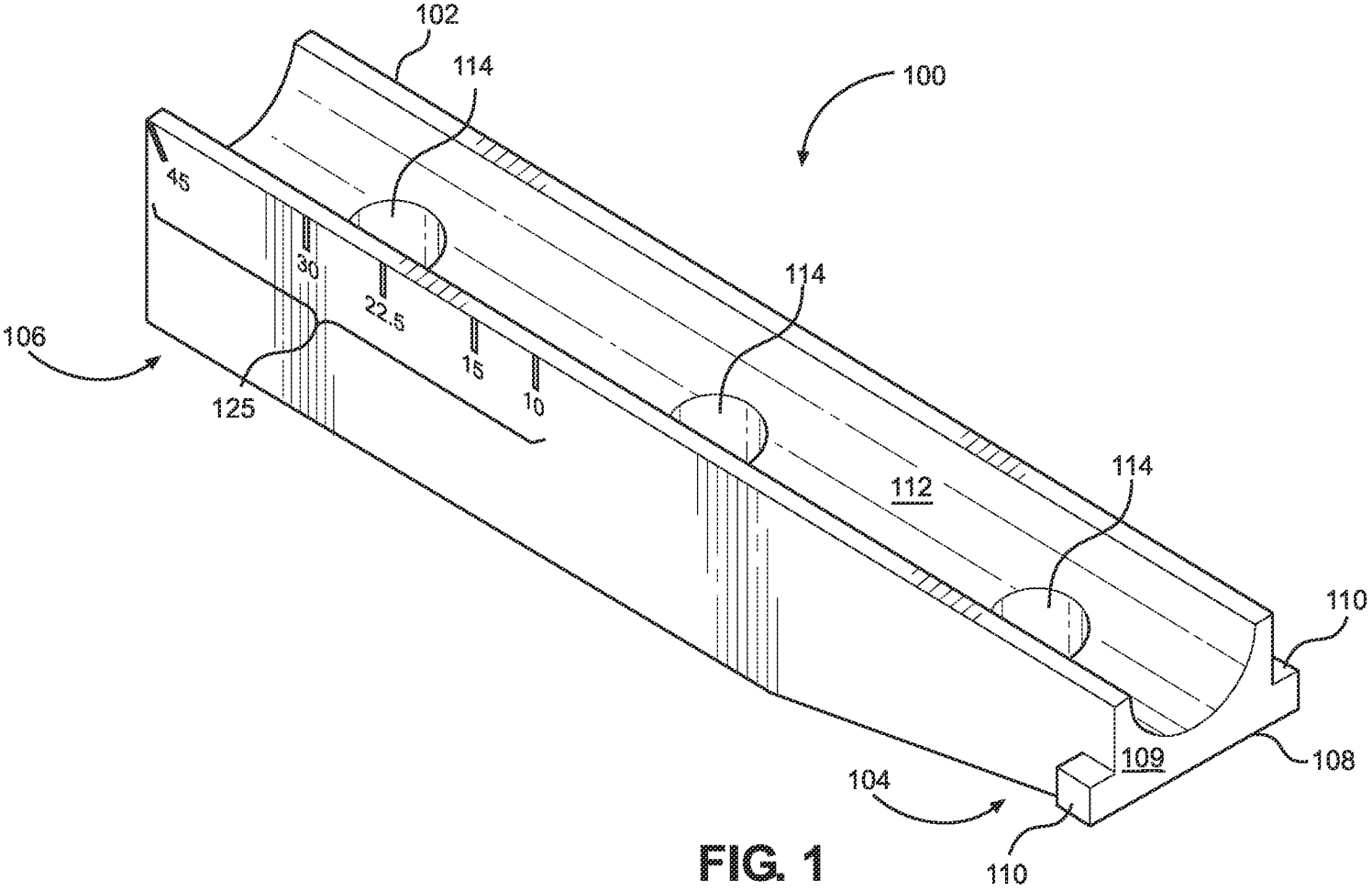
FIG. 1 is a perspective view of an adjustable angle stop for bending conduit in accordance with an example embodiment.

An example adjustable angle stop 100 for bending conduit generally comprises an elongated body 102 comprising a first end 104 and a second end 106 and a stop element 110, such as two stop tabs 110, at the first end 104, and an inner surface 112 on the elongated body 102 adapted to engage a conduit 130. The stop element 110 may comprise two tabs that extend outwardly from the elongated body 102, or it may simply be an extended portion of the elongated body 102 of any shape or size. The elongated body 102 may also include one or more magnets 114 mounted on the elongated body such that the magnets 114 can removably attach the elongated body 102 to the conduit 130 such that the conduit 130, or specifically, the outer surface 132 of the conduit, contacts the inner surface 112, wherein the elongated body 102 is attachable to the conduit 130 in a first position and a second position.

The elongated body 102 may further include at least one indexing element 125 near the second end 106, the at least one indexing element 125 usable to place an indicator 134 on the conduit 130 at a predetermined distance from the first end 104 when the elongated body 102 is attached to the conduit 130 in the first position, wherein the indicator 134 is usable when attaching the elongated body 102 to the conduit 130 in the second position by indicating the second position. The stop element 110 is adapted to contact a part 142 of a bending tool 140 when the elongated body 102 is in the second position, such that the conduit 130 can be bent at a predetermined angle that is indicated by the at least one indexing element 125 when the stop element 110 is contacted by the bending tool 140, such as surface 142 of the bender's shoe.

In some example embodiments, the inner surface 112 of the elongated body 102 comprises a partial cylindrical surface, although of course other shapes are possible. Further, the elongated body 102 may have a plurality of magnets 114, which may have top surfaces 115 that are substantially continuous with the inner surface 112 of the elongated body 102, although they may also differ, such as if the inner surface is formed as a V-block, and the magnets 114 have partial cylindrical surfaces to better engage and hold the metallic conduit 130.

In some example embodiments of the adjustable angle stop 100, the at least one indexing element 125 may comprise a plurality of indexing elements 125. Further, the indexing elements 125 can comprise numbers (and also guide lines) that represent angles at which the conduit 130 can be bent when one of the plurality of indexing elements is used to place the indicator 134 on the conduit 130.

The elongated body 102 may comprise a wedge shape at the first end 104, such that the elongated body 102 is narrower at the first end 104 than it is at the second end 106. Accordingly, the wedge shape creates an angle with the part of the bending tool 140 that is different from an angle between the part of the bending tool 140 and a longitudinal axis of the elongated body 102.

The adjustable angle stop may be used by attaching the elongated body 102 to the conduit 130 in the first position and placing an indicator 134, such as a mark, scratch, tape, etc., on the conduit 130 adjacent to the indexing element 125. The method of use may further include attaching the elongated body 102 to the conduit 130 in the second position, as indicated by alignment of the first end 104 with the indicator 134 or mark, and then bending the conduit 130 with the bending tool 140 until a part 142 of the bending tool 140 contacts the stop element 110. In this manner, the conduit 130 can be bent to a predetermined angle corresponding to the indexing element 125 used to place the indicator 134 or mark on the conduit 130.

B. Elongated Body

Figure 4:
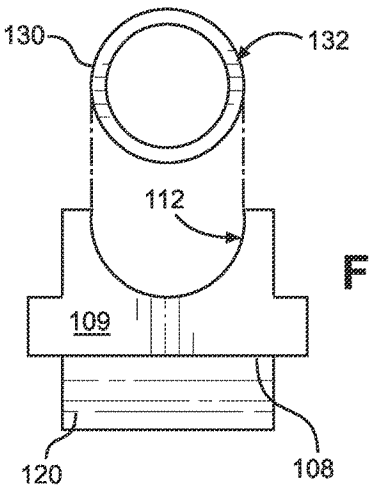
FIG. 4 is an end view of an adjustable angle stop for bending conduit in accordance with an example embodiment.

As best shown in FIGS. 1-4, the adjustable angle stop 100 for bending conduit has an elongated body 102 with a first end 104 and a second end 106, and a stop element 110. The elongated body may be made of metal, such as aluminum, or any other suitable metal or non-metallic, rigid material. In an example embodiment, the elongated body 102 may be in the generally form of a long, rectangular shape with a channel having an inner surface 112 adapted for attaching the angle stop 100 to a piece of conduit 130. The inner surface may be in the shape of a partial cylinder, such that a standard sized metal conduit will fit securely against the surface 112—specifically, so that the outer surface 132 of conduit will fit against surface 112, as illustrated in FIG. 4. Other shapes are also possible, and may, for example, be made so that conduit of multiple sizes can be used with the adjustable angle stop 100 without using a different angle stop.

Figure 2:
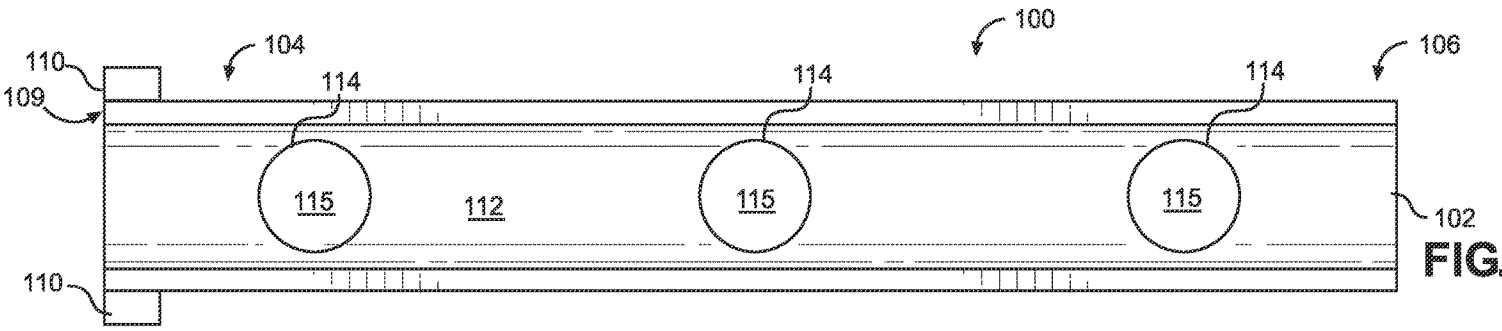
FIG. 2 is a top view of an adjustable angle stop for bending conduit in accordance with an example embodiment.
Figure 3:
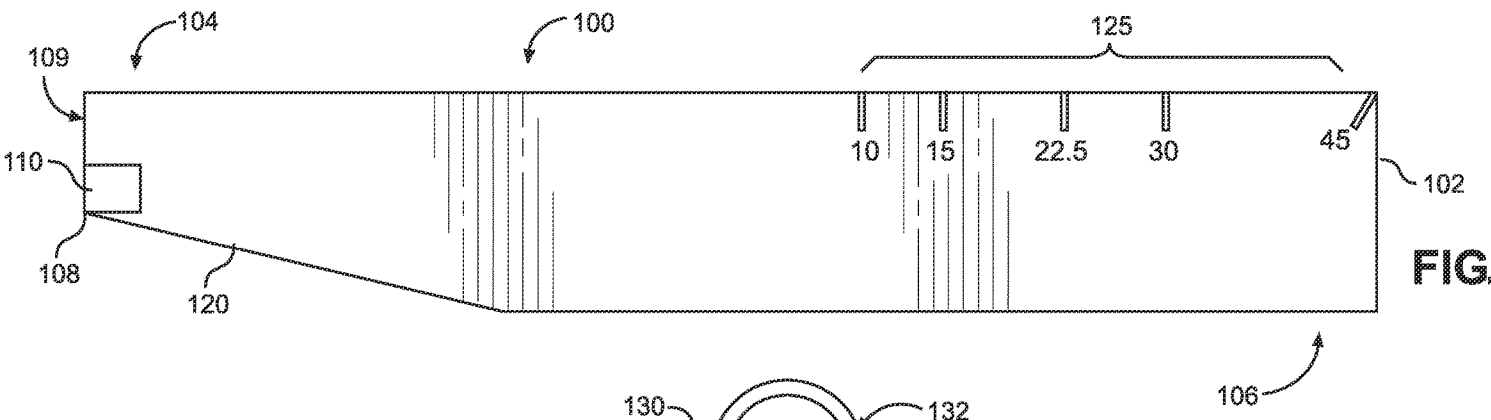
FIG. 3 is a side view of an adjustable angle stop for bending conduit in accordance with an example embodiment.

The elongated body 102 may also include one or more magnets 114 embedded or attached to the body 102. The magnets are usable to attach the adjustable angle stop 100 to a piece or section of metallic conduit 130 that a user wishes to bend at an angle. As best shown in FIGS. 1 and 2, the magnets 114 may be made with an upper surface 115 that is a partial cylinder of the same diameter as surface 112 of the elongated body 102, and may further be attached or embedded so that the surfaces of the magnets and the elongated body 102 are substantially continuous, with just a small gap between the surfaces 115 of the magnets 114 and the surface 112 of the elongated body 102. This configuration allow the adjustable angle stop 100 to be removably attached to a metallic conduit 130 quite securely, due to the strength of the magnets 114 and the close contact with the surface 132 of conduit 130.

Further, the elongated body may have a tapered portion or part 120, so that the elongated body 102 has a wedge shape, particularly near or at first end 104. The wedge shape affects the angle at which the outer surface 142 of the curved bending shoe of bending tool 140 contacts the angle stop 100, the function of which will be described in more detail below.

The elongated body 102 also has a stop element 110, such as two stop tabs at the first end 104 of the elongated body 102. The stop element 110 may comprise two tabs that extend outwardly from the elongated body 102, or it may simply be an extended portion of the elongated body 102 of any shape or size. The elongated body 102 includes an end surface 109 at first end 104, which may be used to align the angle stop with a part of conduit 130, as discussed below. The stop element 110 may have an edge 108 formed where surface 109 meets the wedge-shaped part of the angle stop, as shown for example in FIGS. 1-4 and 6-9.

Figure 5:
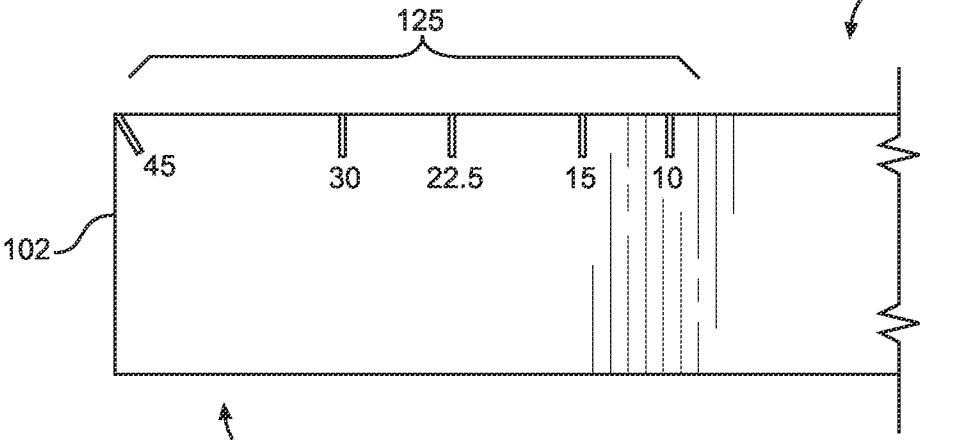
FIG. 5 is a detail side view of a portion of an adjustable angle stop for bending conduit in accordance with an example embodiment.

The elongated body may also include a plurality of indexing elements 125 at or near the second end 106 of the elongated body 102. The indexing elements 125, as best shown in FIG. 5, correspond to angles at which conduits can be consistently and repeatedly bent. The indexing elements 125 may be molded, cast, or otherwise made part of the adjustable angle stop 100, or may be in the form of an attachable sticker or adjustable, attachable piece near second end 106 that can be moved to make the adjustable angle stop usable with different bending tools. The indexing elements 125 comprise numbers corresponding to angles, and also indicator marks for each number, so that an indicator 134 or mark that will result in a particular bend angle can be accurately made or placed on a conduit 130. Although other angles are possible, the angle stop 100 may include indexing elements for 10°, 15°, 22.5°, 30°, and 45°, which are typical bend angles useful in working with conduit.

C. Operation of Preferred Embodiment

In use, the adjustable angle stop 100 may be used by magnetically, or using other means, attaching the elongated body 102 to the conduit 130 in a first position and placing an indicator 134, such as a mark, scratch, tape, etc., on the conduit 130 adjacent to an indexing element 125. The "first position" is the position shown in FIG. 6, which is used simply to place and indicator 134 on conduit 130. The terms first position and second position refer to the position of the angle stop when it is attached to a conduit 130, relative to an end of the conduit or a mark, etc., as will be described further below. As shown, the indicator 134 will be placed at a different distance from the end 136 of the conduit. In this example, the end of the conduit 130 is used, but as will be described further, the adjustable angle stop 100 can also be used to make bends at accurate angles anywhere on a conduit.

Figure 6:
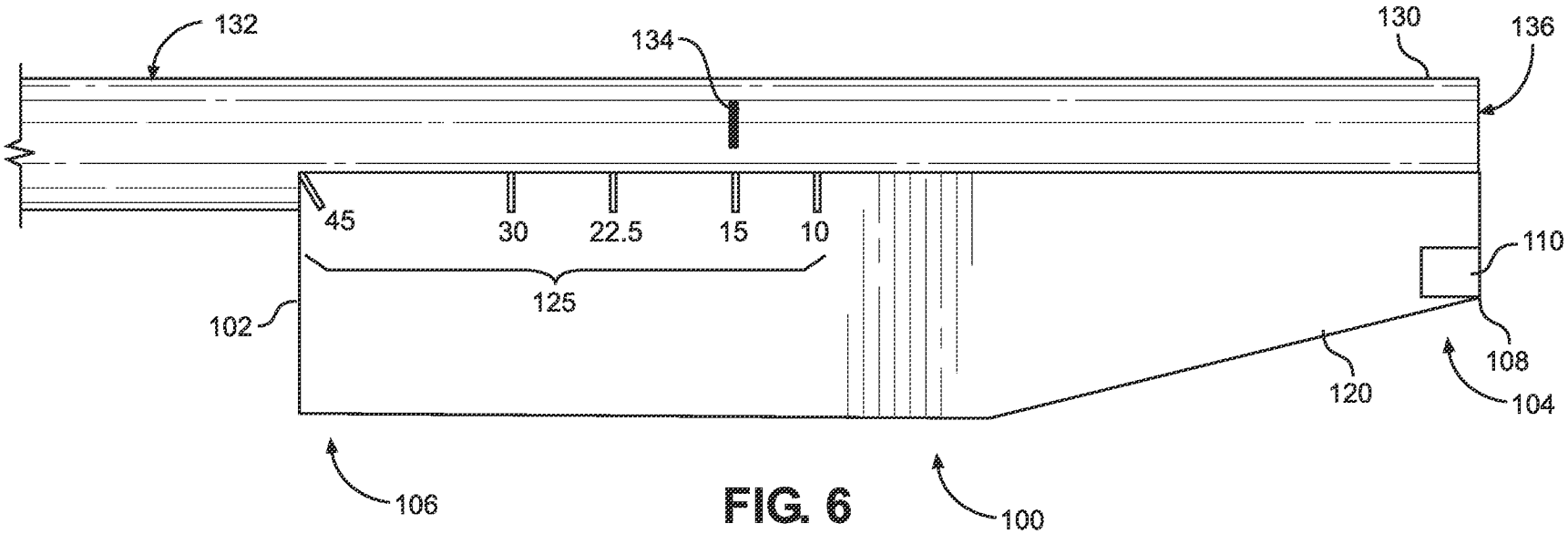
FIG. 6 is a side view of an adjustable angle stop for bending conduit in use accordance with an example embodiment.

As shown in FIG. 6, a user wishes to make an accurate 15° bend in the end of a conduit 130. In such a case, the end 104 of the elongated body 102 is aligned with the end of conduit 130, and specifically, surface 136. Then, the user places an indicator 134, which may be a mark, scribed line, tape edge, etc., on conduit 130 next to the 15° indexing element as shown. During this step, the adjustable angle stop 100 is held securely in place on the metallic conduit 130 by magnets 114. The indicator 134 in FIG. 6 is at a predetermined distance from the end of conduit 130, which will result in a 15° bend due to the design of the adjustable angle stop 100 and the bending tool 140.

Figure 7:
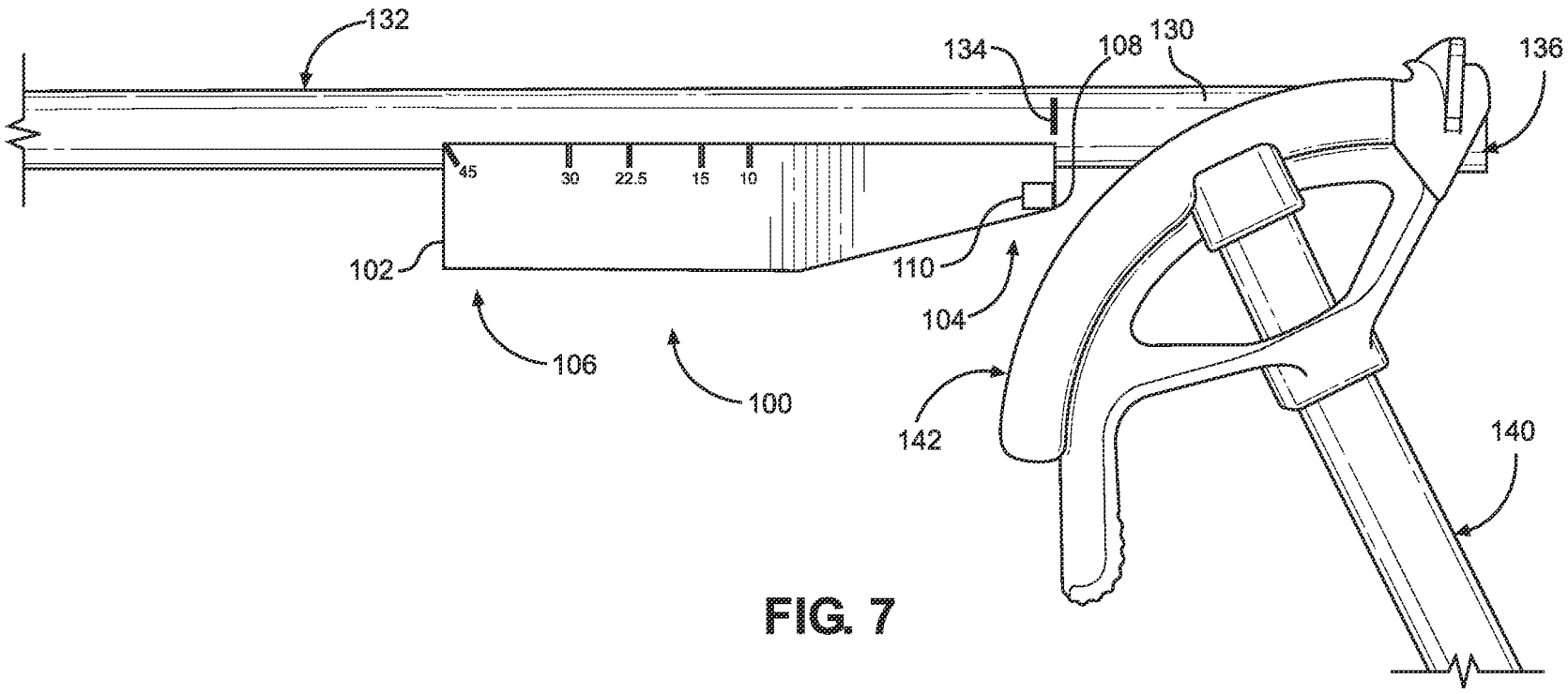
FIG. 7 is another side view of an adjustable angle stop for bending conduit in use accordance with an example embodiment.
Figure 8:
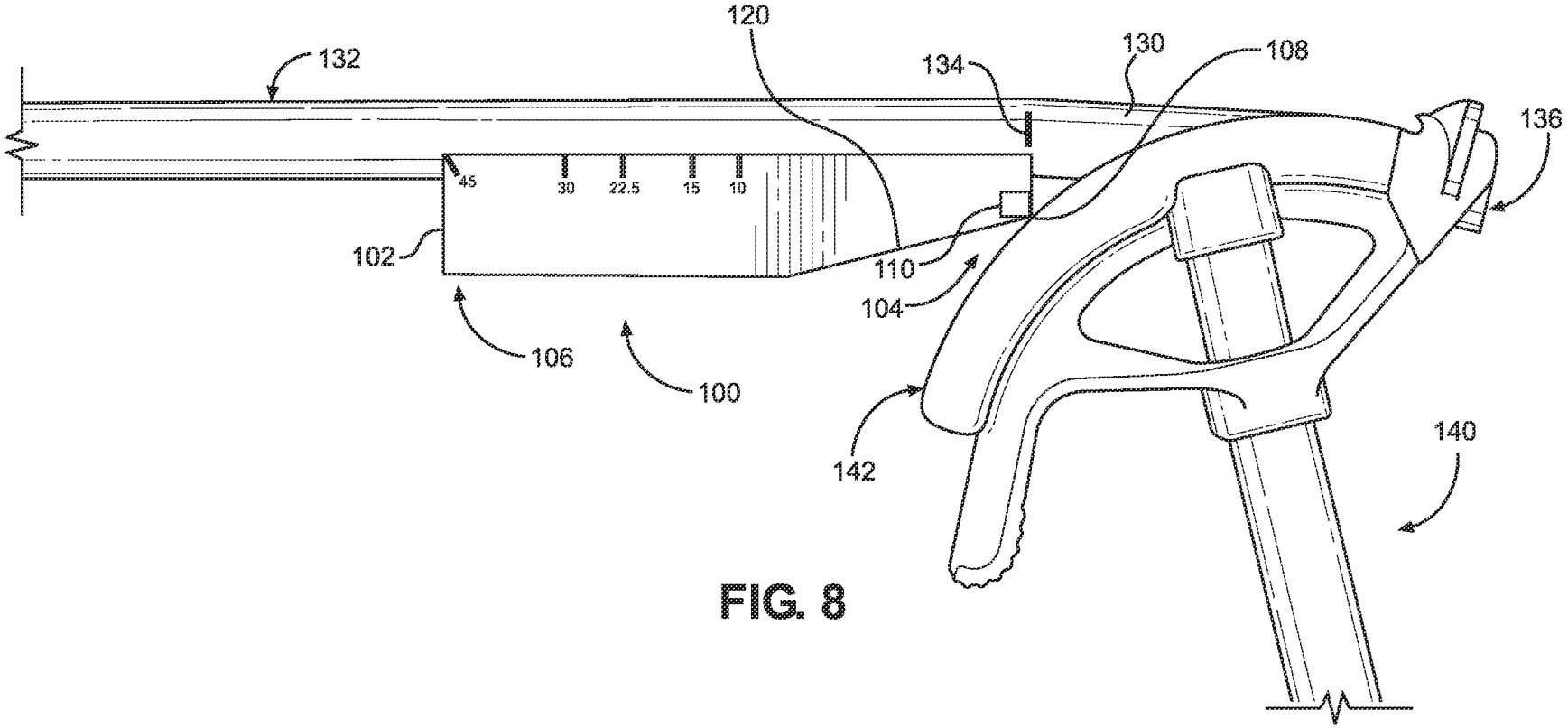
FIG. 8 is another side view of an adjustable angle stop for bending conduit in use accordance with an example embodiment.
Figure 9:
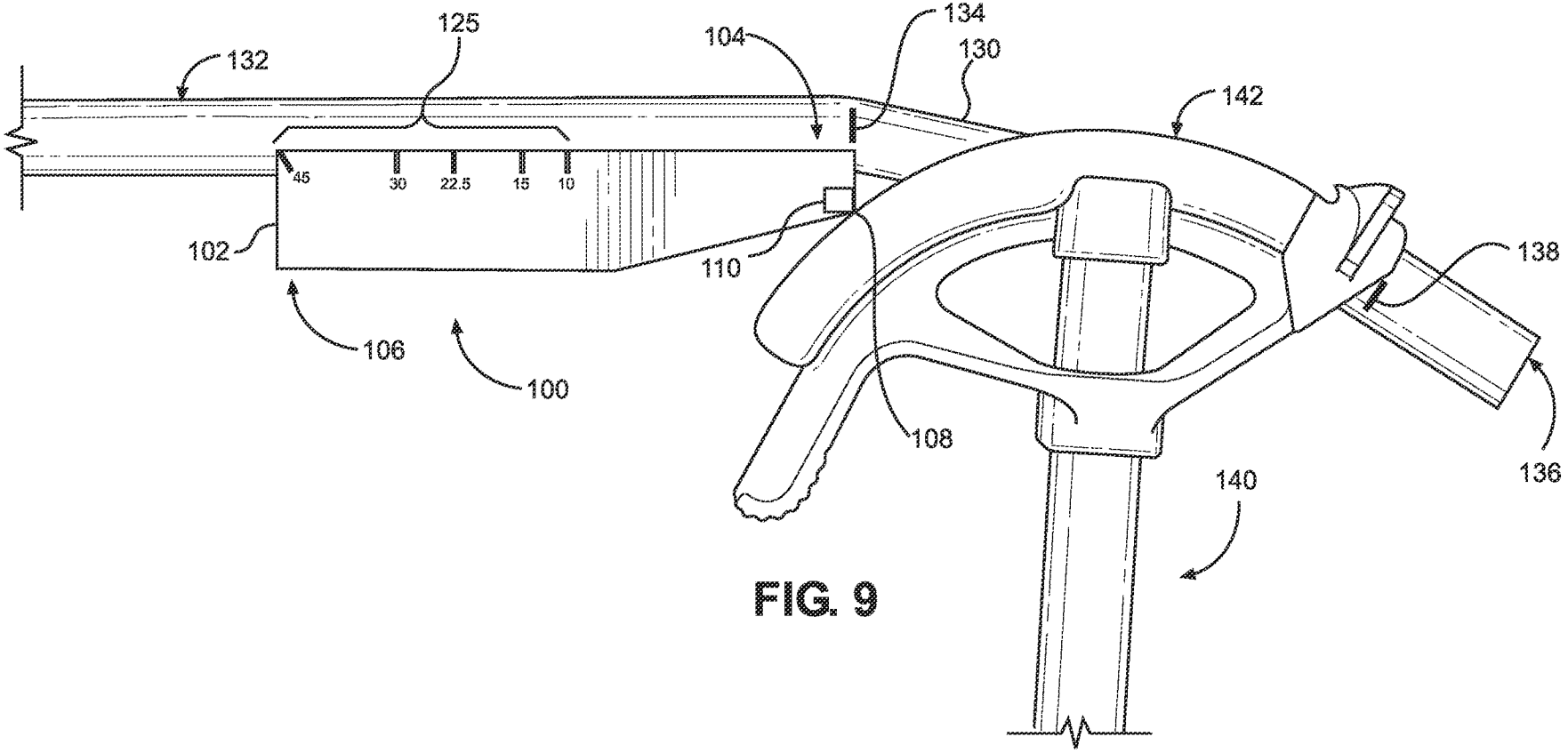
FIG. 9 is another side view of an adjustable angle stop for bending conduit in use accordance with an example embodiment.

Next, the adjustable angle stop 100 is placed in the second position, as shown in FIGS. 7-9. Again, the adjustable angle stop 100 is held in the second position by the magnets 114, or may be held in position by other means or mechanisms. The proper position in this example is when the surface 109 of elongated body 102 is aligned with the indicator 134 on conduit 130. As can be appreciated, this places the stop elements 110 at a known distance from the end of conduit 130, and also at a predetermined distance from the surface of the conduit. This distance may vary to accommodate different bending tools 140, and the variance may be accounted for or made by making an adjustable angle stop 100 with movable indexing elements 125, or by creating an adjustable angle stop 100 for specific bending tools.

To begin the bending process, the bending tool 140 is placed on the conduit 130 as shown, with the end 136 of the conduit 130 aligned with the end of the tool 140 as shown.

Then, the conduit is bent as shown in FIG. 8, until the edge or outer surface 142 of bending tool 140 makes contact with the stop element 110, at edge 108. This positive stop is especially advantageous when bending large conduit, using the floor for leverage. In such cases, visual angle indicators on bending tools are of little use, since the user can be unable to see them. But the stop element 110 are effective in any position, since a user can feel the contact, and also because further bending is impeded by the stop element 110. Since the adjustable angle stop 100 is removably attached to the conduit 130, if it were not designed properly, it may be possible for it to slide out of position on the conduit 130. However, due to the wedge shape, such movement (e.g., movement of the angle stop leftward in FIG. 8) is prevented by reducing any displacement force along the longitudinal axis of the conduit or tool. Specifically, the wedge shape changes the angle of contact between the curved surface 142 of bending tool 140 and the stop element 110, as can be seen in FIG. 8. If the elongated body 102 was not wedge shaped at first end 104, the angle of surface 142 of the bending tool 140 and surface 109 of the elongated body 102 would be smaller, and the bending tool would have a greater tendency push or slide the elongated body 102 to the left as shown in FIGS. 8 and 9.

The method of use may further include attaching the elongated body 102 to the conduit 130 in the second position, as indicated by alignment of the first end 104 with the indicator 134 or mark, and then bending the conduit 130 with the bending tool 140 until a part 142 (such as the surface of the bending shoe) of the bending tool 140 contacts the stop element 110. Again, the angle stop 100 can be attached with magnets 114, or by other means. As shown in FIGS. 8 and 9, the second position is predetermined relative to where the bending tool 140 is, so that the part 142 of the bending tool 140 will contact the stop element 110 when the desired angle of bend is achieved. In this manner, the conduit 130 can be bent to a predetermined angle corresponding to the indexing element 125 used to place the indicator 134 or mark on the conduit 130. As can be seen, when a user places the indicator 134 farther from the end of conduit 130 (by, for example, using the 45° indexing element), the adjustable angle stop 100 will be farther toward the left in FIGS. 7-9, which will result in greater rotation of the bending tool 140, such that the conduit will be bent at 45°.

As shown in FIG. 9, rather than aligning the angle stop 100 at the end of a piece of conduit 130, the angle stop 100 can be placed in the first position relative to a mark 138 on the conduit. Accordingly, an accurate bend can be made in the conduit anywhere along the length of the conduit. In either mode of use, the adjustable angle stop 100 can be used to make quick, precise, and repeatable bends when bending offsets and saddles, and further, its use results in less wasted conduit from inaccurate bends, and also saved time by elimination of the need for fixing or re-bending improper bends.

Unless otherwise defined, all technical and scientific terms used herein have the same meaning as commonly understood by one of ordinary skill in the art to which this invention belongs. Although methods and materials similar to or equivalent to those described herein can be used in the practice or testing of the adjustable angle stop for bending conduit, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The adjustable angle stop for bending conduit may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A method of using an adjustable angle stop comprised of an elongated body comprising a first end, a second end, a stop element at the first end, an inner surface, and at least one indexing element, and a magnet mounted on the elongated body, the method comprising the steps of:

attaching the elongated body to a conduit in a first position;

placing an indicator on the conduit adjacent to the at least one indexing element;

attaching the elongated body to the conduit in a second position, as indicated by alignment of the first end with the indicator; and bending the conduit with a bending tool until the part a portion of the bending tool contacts the stop element;

wherein the conduit is bent to a predetermined angle corresponding to the at least one indexing element used to place the indicator on the conduit.

2. The method of claim 1, wherein the first position comprises a position of the elongated body in which the first end is aligned with an end of the conduit, wherein the end of the conduit is bent to the predetermined angle.

3. The method of claim 1, wherein the first position comprises a position in which the first end is aligned with a mark on the conduit, wherein the conduit is bent to the predetermined angle at a location spaced apart from an end of the conduit.

4. The method of claim 1, wherein the at least one indexing element comprises a plurality of indexing elements comprising numbers that represent angles at which the conduit can be bent when one of the plurality of indexing elements is used to place the indicator on the conduit.

5. The method of claim 1, wherein the stop element comprises two tabs that extend outwardly from the elongated body, and wherein the portion of the bending tool contacts the stop element when the conduit is at the predetermined angle.

6. The method of claim 1, wherein the inner surface comprises a partial cylindrical surface.

7. The method of claim 1, wherein the at least one indexing element comprises a plurality of indexing elements.

8. The method of claim 1, wherein the at least one indexing element comprises a number that represents an angle at which the conduit can be bent when the at least one indexing element is used to place the indicator on the conduit.

9. The method of claim 1, wherein the elongated body comprises a wedge shape at the first end, such that the elongated body is narrower at the first end than it is at the second end.

10. The method of claim 1, wherein the stop element comprises two tabs that extend outwardly from the elongated body.

11. A method of using an adjustable angle stop comprised of an elongated body comprising a first end, a second end, a stop element at the first end, an inner surface, and at least one indexing element, the method comprising the steps of:

attaching the elongated body to a conduit in a first position;

placing an indicator on the conduit adjacent to the at least one indexing element;

attaching the elongated body to the conduit in a second position, as indicated by alignment of the first end with the indicator; and bending the conduit with a bending tool until a portion of the bending tool contacts the stop element;

wherein the conduit is bent to a predetermined angle corresponding to the at least one indexing element used to place the indicator on the conduit.

12. The method of claim 11, wherein the first position comprises a position of the elongated body in which the first end is aligned with an end of the conduit, wherein the end of the conduit is bent to the predetermined angle.

13. The method of claim 11, wherein the first position comprises a position in which the first end is aligned with a mark on the conduit, wherein the conduit is bent to the predetermined angle at a location spaced apart from an end of the conduit.

14. The method of claim 11, wherein the at least one indexing element comprises a plurality of indexing elements comprising numbers that represent angles at which the conduit can be bent when one of the plurality of indexing elements is used to place the indicator on the conduit.

15. The method of claim 11, wherein the stop element comprises two tabs that extend outwardly from the elongated body, and wherein the portion of the bending tool contacts the stop element when the conduit is at the predetermined angle.

16. The method of claim 11, wherein the inner surface comprises a partial cylindrical surface.

17. The method of claim 11, wherein the at least one indexing element comprises a number that represents an angle at which the conduit can be bent when the at least one indexing element is used to place the indicator on the conduit.

18. The method of claim 11, wherein the elongated body comprises a wedge shape at the first end, such that the elongated body is narrower at the first end than it is at the second end.

19. The method of claim 11, wherein the stop element comprises two tabs that extend outwardly from the elongated body.

20. A method of using an adjustable angle stop comprised of an elongated body comprising a first end, a second end, a stop element at the first end, an inner surface, and a plurality of indexing elements on a side of the elongated body, the method comprising the steps of:

attaching the elongated body to a conduit in a first position;

placing an indicator on the conduit adjacent to one of the plurality of indexing elements;

attaching the elongated body to the conduit in a second position, as indicated by alignment of the first end with the indicator; and bending the conduit with a bending tool until a portion of the bending tool contacts the stop element;

wherein the conduit is bent to a predetermined angle corresponding to the at least one indexing element used to place the indicator on the conduit.

* * * * *